United States Patent [19]

Reis

[11] 4,146,081

[45] Mar. 27, 1979

[54] APPARATUS FOR DIE CASTING

[76] Inventor: Walter Reis, Frankenstrasse 1, 8753 Obernburg, Fed. Rep. of Germany

[21] Appl. No.: 823,756

[22] Filed: Aug. 11, 1977

[30] Foreign Application Priority Data

Aug. 14, 1976 [DE] Fed. Rep. of Germany ..... 2636665
Sep. 13, 1976 [DE] Fed. Rep. of Germany ..... 2641116

[51] Int. Cl.[2] ..... B22C 19/04; B22D 17/32

[52] U.S. Cl. ..... 164/155; 164/61; 164/136; 164/256; 164/336; 425/546

[58] Field of Search ..... 164/61, 155, 193, 256, 164/257, 336, 136; 425/256, 580, 586, 591, 566, 571, 547, 546, DIG. 228, 450.1, 812, 149

[56] References Cited

U.S. PATENT DOCUMENTS

| | | | |
|---|---|---|---|
| 2,610,372 | 9/1952 | Schroeder | 164/257 |
| 3,019,495 | 2/1962 | Cornell | 164/256 X |
| 3,103,698 | 9/1963 | Wollett | 425/DIG. 60 |
| 3,321,806 | 5/1967 | Beebee | 425/149 |
| 3,335,462 | 8/1967 | Grigull et al. | 425/546 |
| 3,393,837 | 7/1968 | Takeshima | 164/336 X |

*Primary Examiner*—Robert L. Spicer, Jr.

*Attorney, Agent, or Firm*—W. G. Fasse; D. F. Gould

[57] ABSTRACT

The present method and apparatus for die casting of metals such as aluminum, is especially suitable for casting under vacuum. The casting is performed under such operating conditions that a contact between the molten metal being cast and the free atmosphere is avoided all the way from the melt to the casting proper. For this purpose, the present casting apparatus includes a closeable and evacuable transport container connected to the casting apparatus proper by a coupling which is also evacuable. The transport container is placed on a filling chamber and the evacuating apparatus is arranged to simultaneously evacuate the filling chamber, the transport container and the coupling between the transport container and the filling chamber proper. The evacuation takes place in a direction opposite to the flow direction of the metal being cast. If desired, further evacuating means may be provided for evacuation of the filling chamber and the die in the direction of the metal flow. The vacuum is switched off in response to the operation of a pressure piston after the filling opening of the filling chamber has been closed.

8 Claims, 10 Drawing Figures

APPARATUS FOR DIE CASTING

BACKGROUND OF THE INVENTION

The present invention relates to a method and apparatus for pressure or die casting of metals, for example aluminum, whereby the pressure casting dies are evacuated. Heretofore several steps have been taken in connection with pressure die casting to improve the quality of the cast work pieces particularly to improve the structure or texture of such work pieces, especially to avoid or at least diminish air and gas inclusions.

Thus, it is for example known to connected the hollow spaces of the dies and of the filling chamber to a vacuum pump for evacuating these spaces. For this purpose, several steps are necessary to make the dies or casting molds and the casting machines compatible for the performance of such methods. For example, it is necessary to provide special suction channels having predetermined lengths. Further, it is necessary to assure a timely switch-off between the vacuum conduit and the hollow spaces as well as the channel system of the mold. This was accomplished heretofore by means of valves and control systems for such valves. However, such switching-off is a source of trouble and causes problems in the operation of such prior art casting machines.

Basically, all prior art pressure die casting machines operate on the principle that the filling opening of the filling chamber of the pressure casting machine is closed after filling of the molten metal is completed, said closing being performed by the feed advance of the pressure applying piston. Simultaneously, with such closing the evacuation of the die and the filling chamber is switched on. It is a substantial disadvantage of this type of operation that for evacuation of the total volume of all the hollow spaces, that is of the filling chamber, of the dies, and the suction channels, there is very little time available, namely the time during which the pressure applying piston advances to the point of filling the die or mold.

Yet another disadvantage of prior art devices is seen in that their operational safety is quite different in different known devices. However, in all prior art devices there is the danger that as a result of a failure of the mentioned control mechanisms, it is possible that the switching-off of the vacuum does not take place on time whereby molten metal may enter into the control devices, whereby the latter may be destroyed or at least damaged.

Another problem with prior art devices is the possibility of spilling of the molten metal. In this connection it has been proposed to control the feed advance of the pressure piston to move the latter first slowly and then with an increasing speed so that such spilling of molten metal in the horizontally arranged filling chamber is avoided. A further purpose of such piston advance control is to avoid the production of porous cast work pieces by preventing the formation of a metal air mixture.

Another drawback of prior art methods for pressure or die casting is seen in that the rather expensive control mechanisms and additional steps are geared to particular types of machines and cannot be employed where it is desired to subsequently adapt molds and machines to pressure casting procedures.

Another requirement to be met in pressure die casting is the avoidance of oxide formations on the surface of the liquid or molten metal during the transporting, the filling and during the casting proper. This may be accomplished, for example, by covering the molten metal surface with an inert gas during the ladling, dosing and casting operations. However, for this purpose again expensive equipment is necessary. Besides, substantial quantities of inert gas are also required.

In connection with the so called cold chamber pressure casting method, the molten metal is supplied by means of a ladle which removes the molten metal from a crucible furnace into the filling opening of the die casting machine. A number of mechanical ladling mechanisms are known in the art capable of performing or controlling the ladling operation by mechanical or automatic means.

Aside of the casting devices operating with mechanical ladling mechanisms, there are devices known in which the molten metal is sucked into the filling chamber by evacuating the pressure casting die or mold as well as the filling chamber through a riser pipe immersed into the molten metal. These prior art devices are known under their respective names Nelmor, Morton and others. However, the known devices did not catch any substantial market, because of the requirement that the liquid metal supply must be located at a level lower than the level of the filling chamber of the pressure casting machine. Another problem of these known machines is seen in the dosing or proportioning of the metal supply. In addition, the entire filling pipe is exposed to the free atmosphere upon completion of the respective casting operation. This causes oxidation problems internally of the die or mold as well as relative to the metal to be cast whereby the quality of the cast work pieces is influenced in a disadvantageous manner.

OBJECTS OF THE INVENTION

In view of the foregoing, it is the aim of the invention to achieve the following objects, singly or in combination:

- to avoid the drawbacks of the prior art, especially also those encountered in connection with devices requiring a so called riser pipe;
- to provide a method and apparatus for the pressure die casting of metal such as aluminum which is especially adaptable for cooperating with known casting devices without any substantial adaptation requirements;
- to provide a method and apparatus for pressure die casting wherein any contact between the molten metal and the free atmosphere is prevented throughout the operation, namely from the time the melt is ready for casting to the completion of the casting;
- to evacuate the filling chamber and the die or mold in such a direction that the evacuation flow and the metal flow are opposite to each other or are in the same direction;
- to employ such evacuation operations that certain evacuations take place with an evacuation flow in the direction of the metal flow whereas other evacuations take place with a evacuation flow direction opposite to the flow direction of the molten metal;
- to avoid the oxidation of the molten metal during its transport, during the filling and during the casting;
- to avoid the spilling of the molten metal as well as any mixing of the molten metal with air or any other vapors or gases; and to improve the quality of the cast product, especially its inner structure or texture.

SUMMARY OF THE INVENTION

According to the invention there is provided a method for pressure or die casting of metals, for example aluminum, wherein the pressure casting die or mold is evacuated and wherein any contact of the molten metal and the free atmosphere is prevented, beginning with the melting to the final casting.

Preferably, this is accomplished by maintaining the metal under vacuum during the filling of the transport container as well as during its influx into the die or mold, thereby avoiding any interruption in the vacuum maintenance. Preferably, the evacuation flow of the filling chamber and the mold takes place in a direction opposite to the flow of the molten metal. In addition, the vacuum in the filling chamber and in the mold may be enhanced by a supplemental evacuation, having an evacuation flow in the flow direction of the metal, such additional evacuation being maintained until the metal has solidified.

According to the invention there is further provided an apparatus for performing the above method steps of the invention wherein a closeable and evacuable transport container is connected by an evacuable connecting means, such as a coupling or fitting, to the casting machine proper. An evacuating device is connected for the simultaneous evacuation of the coupling or fitting as well as of the filling chamber and the mold or die, said evacuation taking place in a flow direction opposite to that of the flow direction of the molten metal. A further evacuating device may be provided for evacuating the filling chamber and the mold or die in the direction of the molten metal flow and said further evacuation is maintained until the completion of the filling operation. The evacuable transport container for the molten metal is moved through an arc by drive means in such a manner that the container will maintain a vertical position at all times on its way out of a melt supply and into a coupling for discharging molten metal into the mold under vacuum. The vertical position of the container is also maintained on its return trip.

Further, there is provided a device for switching off the vacuum at the transport container and at the coupling or fitting between the transport container and the casting apparatus after the closing of the filling opening by the pressure applying piston means.

Where it is desired that the method of the invention is to be performed without the additional or auxiliary evacuation with an evacuation flow in the filling direction of the flowing metal, the respective second evacuation means may be omitted.

According to the invention there is further provided an apparatus for performing the present method in which the use of a riser pipe is avoided. For this purpose, according to the invention, a conduit such as a pipe is immersed with one end into the molten metal while the other end is closed by a controllable piston. A coupling or fitting is arranged between the piston controlled conduit or pipe and the filling chamber of the casting apparatus while a releasable connection is arranged between the lower end of the fitting or coupling and the filling opening of the filling chamber. Preferably, a vacuum conduit is connected to the venting opening or to a channel member of the pressure casting mold or die while a further or separate evacuation conduit is connected to said coupling or fitting. The control piston in the immersed pipe may be provided with a longitudinal bore which is also connected to a vacuum conduit. The control piston may be controllable by pneumatic or any other suitable means and it may be under the continuous bias of a pressure spring. A contact vacuum meter may be connected to the vacuum conduit for cooperation with a timer which in turn controls the pneumatic operation of the piston.

BRIEF FIGURE DESCRIPTION

In order that the invention may be clearly understood, it will now be described, by way of example, with reference to the accompanying drawings, wherein:

FIG. 1 is a schematic illustration of an apparatus according to the invention for performing the method of the invention;

FIG. 1*a* shows a detail of the transport container and its operating mechanism;

DETAILED DESCRIPTION OF PREFERRED EXAMPLE EMBODIMENTS

Figure 1:
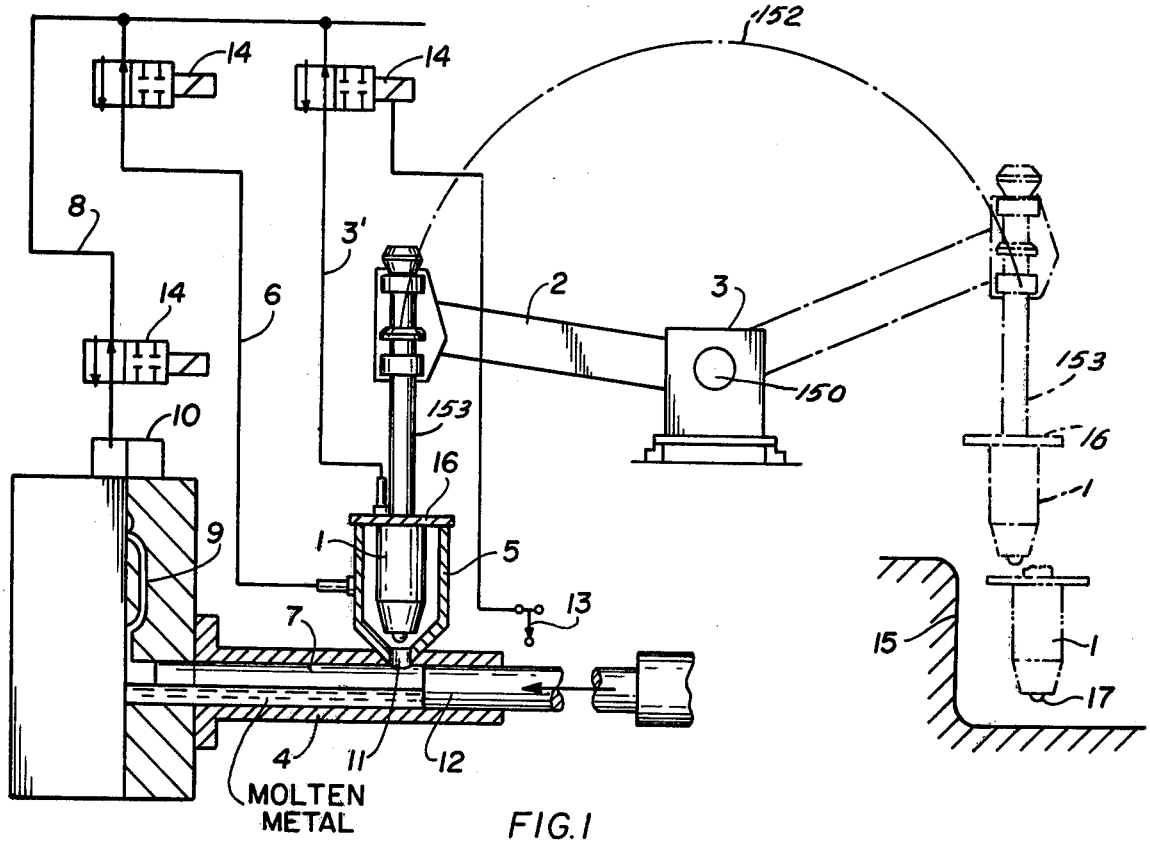
Figure 1A:
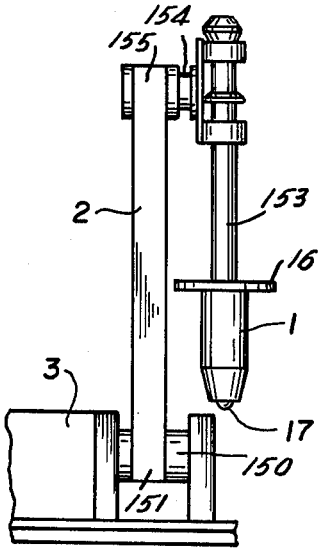
Figure 3:
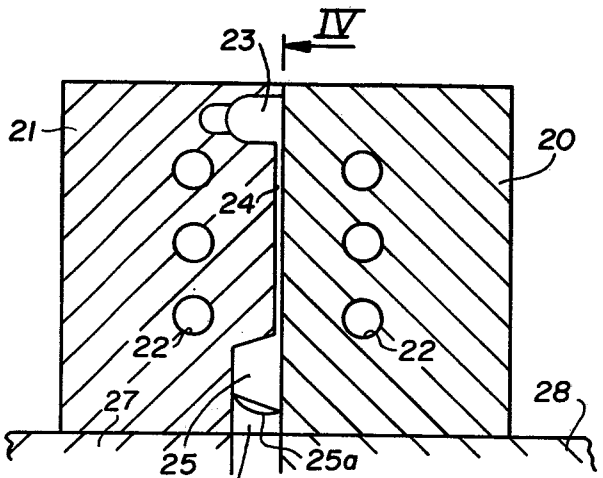
FIG. 3 is a sectional view through the block attachment of FIG. 2 along the section line III—III in FIG. 2.
Figure 5:
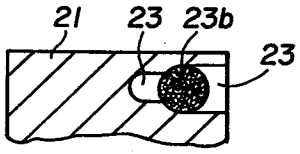
FIG. 5 illustrates a sectional view of an internal detail of the attachment block of FIG. 2.
Figure 4:
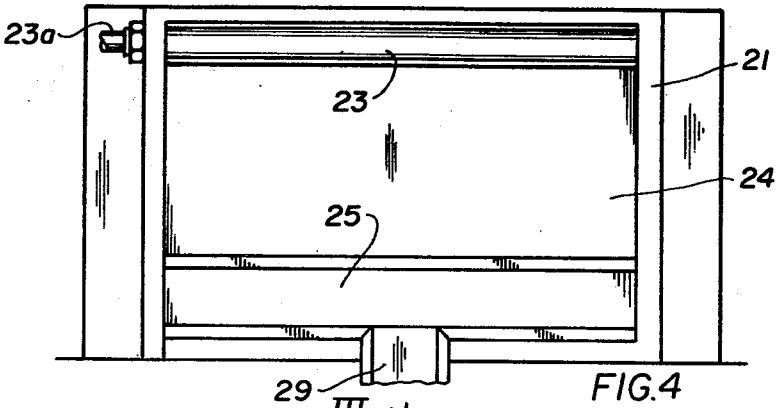
FIG. 4 is a view in the direction of the arrow IV in FIG. 3 and also against the plane as viewed in the direction of the arrows IV in FIG. 2.
Figure 2:
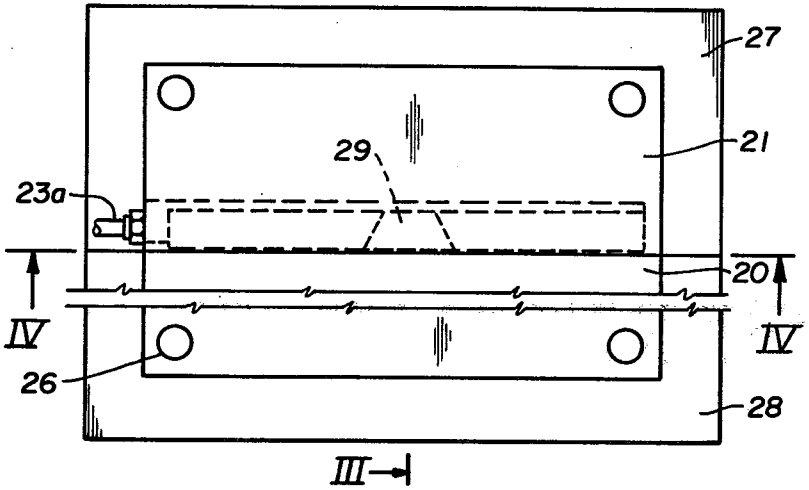
FIG. 2 illustrates a simplified top plan view of a channel member of block attachment arranged between the vent opening of the die or mold and the vacuum conduit.

The apparatus illustrated in FIG. 1 and FIG. 1*a* is adapted for performing the method as defined in present claims 1 to 4. The apparatus includes a closeable and evacuable transport container 1 which is moved back and forth by means of a rotary arm 2 driven by any type of conventional drive means 3, as shown in FIG. 1*a*. The arm 2 is provided with parallel guide means for moving the transport container 1 out of the full line position illustrated in the left hand portion of FIG. 1 into the dash dotted position illustrated in the right hand portion of FIG. 1 and also for moving the transport container 1 back into the left hand position. The drive means 3 have a drive shaft 150. The lower end 151 of the arm 2 is connected to the drive shaft 150 for tilting the arm 2 through an arc 152 between said full line and dash dotted line positions of the container 1. A second arm 153 is connected with its upper end to the other end 155 of the rotary arm 2 by means of a journal bearing 154 extending laterally relative to the arm 2 so that the arm 153 with the container 1 attached to its lower end may clear the arm 2 when the latter tilts through the arc 152 whereby the arm 153 maintains a vertical position at all times including when the container 1 is in the furnace 15 and when the container 1 is in an evacuable discharge fitting 5 which will now be described.

The transport container 1 is operatively connected to an evacuation line 3'. An evacuable coupling or connection means 5, e.g. a fitting is arranged between the transport container 1 and the casting apparatus 4. The fitting 5 is operatively connected to an evacuation conduit or line 6.

The coupling or fitting 5 as well as the filling chamber 7 and the casting apparatus 4 are evacuated simultaneously by means of the vacuum conduits 3' and 6 in such a manner that the evacuation flow is in a direction opposite to the filling direction of the metal flowing into the mold. The vacuum conduit 8 serves for evacuating the filling chamber 7 and the mold 9 in such a manner that this secondary or auxiliary evacuation flow is in the same direction as the metal flow filling the mold. A channel or attachment member 10 is operatively arranged between the venting channel of the pressure casting mold 9 and the vacuum conduit 8. Said attachment member or block 10 will be described in more detail below.

The vacuum of the transport container 1 and of the coupling 5 subsequent to the closing of the filling opening 11 by the pressure applying piston 12 is accomplished by means of an end switch 13 controlling electro magnetic switching valves 14 in the vacuum conduits 3', 6 and 8.

The apparatus according to FIG. 1 avoids all the disadvantages of prior art pressure casting methods and/or equipment and makes it possible to perform a vacuum casting method without any oxidation of the metal during its transport, its filling, and its casting. Nevertheless, no substantial modifications are necessary for this achievement at the casting apparatus nor at the pressure casting dies or molds. Thus, it is possible to perform the method according to the invention with presently operating equipment, the modifications of which are rather inexpensive.

For example, the metal transport may be accomplished by a conventional metal transport container which, however, must be closeable and which may be immersed into the furnace 15 to take up a measured quantity of molten metal by a suitable arrangement and by controlled dipping of the container into the liquid metal supply of the furnace 15. The transport container is evacuated through a conventional evacuation conduit system 3', the pump of which is not shown as it is conventional. The evacuation may take place simultaneously with the filling of the metal or it may take place prior to the filling operation. It is immaterial, whether the evacuation conduit 3' is connected to a central evacuation pump or whether it is connected to an individual pump provided for each casting apparatus.

During the movement of the transport container 1 for connection with the filling chamber 7 through the coupling 5, the container 1 remains continuously under vacuum. This feature avoids the oxidation of the metal and simultaneously enhances the sealing of the filled transport container 1 against any spilling of the molten metal.

The transport container 1 is moved to a position above the filling chamber opening 11 of the pressure casting apparatus 4. The evacuable fitting or coupling 5 is arranged between the transport container 1 and the filling opening 11 of the casting machine 4. The transport container 1 is provided with a closure or cover 16 arranged so as to seal the transport container 1 substantially inside the coupling 5 as shown in the left hand portion of FIG. 1. Thus, the closure 16 serves simultaneously also as a closure for the coupling 5 and for the transport container 1.

The sealing between the filling chamber 7 and the coupling 5 and the dosing and transport container 1 is normally achieveable without any problems and without any substantial expense having regard to presently available equipment. The lower end of the coupling 5 may be provided with a sealing ring assuring an adequate seal between the filling chamber 7 and the coupling 5 around the filling opening 11.

After sealing the connection between the transport container 1 and the filling chamber 7 of the casting apparatus 4, the metal closure valve 17 of the transport container 1 is opened whereby simultaneously with the flowing of the metal into the filling chamber 7, the entire volume of the die or mold and of the filling chamber is connected to the vacuum system 3', 6 and evacuated. If desired, the filling chamber 7 may be directly connected to the vacuum system or the evacuation connection may be established simultaneously and automatically with the placing of the transport container 1 onto the coupling 5 whereby the evacuation of the mold and filling chamber volume may be started prior to the entering of the molten metal into the filling chamber 7. This particular embodiment is important for avoiding the oxidation of the molten metal. The evacuation may be maintained during the entire pressure molding operation. The evacuation system 3' and 6 may be automatically switched off by the motion of the pressure piston 17 as the latter travels in the pressure applying direction.

A further substantial advantage of the method of the invention is achieved due to the fact that the volume of the dies or molds and of the filling chamber remains evacuated till the beginning of the movement of the pressure applying piston 12, because in this manner a mixing of metal and/or air is avoided. As a result, a substantially more rapid pressure piston closure movement may be employed, because it is not necessary to make any conscious effort for avoiding such an intermixing. The more rapid injection of the molten metal into the die or mold has the further advantage that the time during which the metal may cool down is reduced which in turn has the advantage that, if desired, lower metal temperatures may be employed. Lower metal temperatures, on the other hand, have the advantage that they permit a more rapid casting sequence, that they assure a better quality product, and that the possibility of oxidation is reduced, coupled with a substantially reduced wear and tear on the entire equipment, especially the dies or molds.

The automatic interruption of the vacuum conduit 3' and 6 by means of the pressure applying piston 12 obviates all otherwise necessary controlled sealing means requiring valves and similar devices as was necessary heretofore. Thus, faulty control has been eliminated because, according to the invention, a positive coupling between the path of the pressure applying piston 12 and the separation of the vacuum conduits 3', 6 is established.

According to the invention, the hollow spaces are not evacuated over the narrow channels necessary heretofore, but rather directly at the points where the largest volume is, namely, in the area of the filling chamber 7. The hollow space of the filling chamber 7 is normally several times larger than the volume necessary for the cast work piece and for the casting channels.

When evacuating the hollow spaces of a casting apparatus, such as the apparatus 4, in a direction contrary to the flow direction of the metal, one has to take into account that after the closing of the filling opening 11 by the pressure applying piston 12, a further evacuation is not possible. The time span involved is short, however, still sufficiently long that, till the complete filling of the pressure casting die or mold, a reduction in the original vacuum may occur, especially where the molds or dies are not entirely tight. The invention avoids the possibility of a vacuum reduction in that the filling chamber and the mold or die may also be evacuated in the direction of the flowing metal to the point in time when the filling operation is completed. This is accomplished in that the vacuum line or conduit 8 is connected to the venting channel of the pressure casting die or mold 9. Contrary thereto, in known pressure casting methods or equipment, the evacuating conduit is closed by the metal flow through suitable control means.

Contrary to the prior art, the method according to the invention is practiced without any control means operable by the metal flow or by the piston displacement or by a timer. As a result, the invention obviates the control means necessary in prior art equipment, thereby substantially reducing the costs and eliminating trouble prone control components.

Instead of employing a suction valve block or a similar device as is used in known systems, for example, the system known under the tradename "Optivac," the invention uses a channel member or attachment block 10, secured to the venting or evacuating channel of the pressure casting die. This attachment block 10 is constructed so that between the venting channel and the pressure casting die 9 and the vacuum conduit 8 there is provided a conduit section having a cross sectional area over its entire length which is at least as large as the cross sectional area of the venting channel. Further, the conduit section has a cross sectional shape which changes over the length of the conduit section. Thus, the cross sectional area at the beginning of the line section changes or merges into a slot shaped cross sectional area toward the end of the section whereby the thickness of the metal is reduced to a size at which the metal flow is stopped. Stated differently, the shape of the cross sectional area in said conduit section is such, that the thickness of the flowing metal steadily decreases from the beginning of said conduit section to the point where it connects to the suction conduit 8 at which point the cross sectional area is such that it becomes impossible for the flowing metal to keep flowing due to the physical characteristics or behavior of the metal.

FIGS. 2 to 5 illustrate a preferred and advantageous embodiment of the attachment block or member 10 comprising two housing sections. One block or housing section 20 is connected to the fixed die half or member 28. The other block section 21 is secured to the movable die half 27. A suitable insulation, not shown, may be arranged between the die 9 and the block sections 27, 28, since the die 9 is hot during its operation. The insulation must be arranged in such a manner as to minimize the heat transfer between the die or mold 9 or its portions on the one hand and the attachment block 10 or its portions 20, 21.

The inner surface of the block portion 20 is suitably smooth whereas the inner surface of the block portion 21 is provided with recesses in order to form the desired conduit sections when the two block portions or members 20, 21 are closed. The largest proportion of such conduit sections is taken up by the cooling path 24, one end of which merges into the vacuum channel 23 to which there is connected the vacuum conduit **23*a*. The other end of the cooling path 24 merges into the distribution channel 25 which is connected through a channel portion 25*a* to the venting channel 29 of the mold 27, 28**.

The cross sectional area of the channels 25 and **25*a* as well as of the cooling path 24 and of the evacuation channel 23 is at least as large as the cross sectional area of the venting channel 29 of the mold 27, 28. This relative size applies to the entire height of the attachment block members 20, 21. In practice a suitable cross sectional area for the venting channel 29** would be about 50 $mm^2$.

As viewed in the flow direction of the metal, the cross sectional area of the channel section 25 merges into the slot shaped cross sectional area of the cooling path 24. By this feature, the wall thickness of the metal flowing out of the venting channel 29 of the mold 27, 28 into the block attachment 20, 21, is reduced to a size at which the metal flow is stopped. Thus, the metal is stopped from further flowing inside the block attachment 10 depending on the casting pressure, the temperature of the metal as well as the environmental temperature, since the flow resistance encountered by the metal is sufficiently large to cause such stopping.

In practice it could happen, that the two mold halves which are normally rigidly pressed against each other in the mold separating plane, are opened somewhat so that a gap occurs in the mold separating plane. Such movement of the mold halves away from each other would also cause a respective movement of the attachment block sections 20 and 21 whereby the cross sectional area in the cooling path 24 could increase and the cooling effect thereby reduced. In order to avoid the effects of such a situation, the channel or conduit 23 may be provided, according to the invention, with an insert **23*b* made of a porous material, such as a sinter metal. At the latest, the metal will solidify in the area of said insert 23*b* thereby entering into an intimate bond with said insert. Upon completion of the casting the insert 23*b* may then be removed from the channel 23** and replaced by another insert.

The illustrated shape of the attachment block 10 represents but one possible example embodiment. Thus, the shape may be modified without departing from the teaching of the invention, because such teaching is satisfied as long as, within the attachment block, the cross sectional area of the channel is reduced in a manner that the respective metal flow is stopped. Stated differently, The cross sectional area is diminished along the channel length to a point below the flowability of the cast metal without thereby reducing the cross sectional area below the original cross sectional area that is, below the cross sectional area of the venting channel 29 of the mold members 27, 28. As mentioned, the simplest solution to this requirement is seen in that the cross sectional shape of the channel in the attachment block 10 gradually merges into a slot shape.

For the further enhancement of the desired cooling of the flowing metal and to facilitate its solidifying, it is suitable to provide cooling bores 22 in both portions 20 and 21 of the attachment block 10. For example, water may flow as a cooling medium through these bores 22.

Any suitable connecting means 26, such as nuts and bolts, may be employed to hold the two sections 20 and 21 of the attachment block 10 together. The same applies to the two mold portions or mold halves 27 and 28.

The block sections 20 and 21 may be arranged for cooperation with an ejection system, not shown, whereby the metal solidified in the cooling path 24 may be removed, for example, by means of ejection pins which are spring loaded by means of a spring biased plate whereby, for example, as a result of the closing of the die and thus of the attachment block, the springs are cocked by respective pressure pins.

Figure 6:
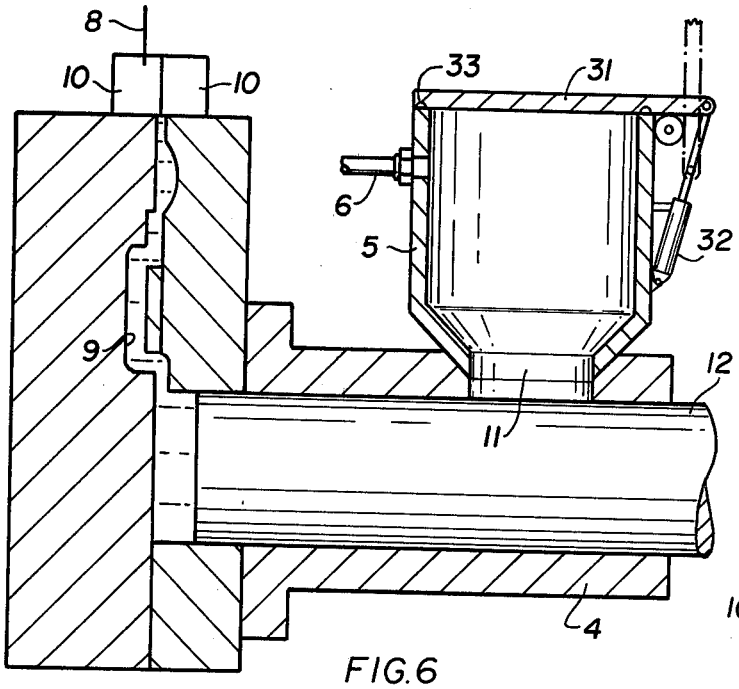
FIG. 6 is a schematic illustration of a casting apparatus for performing a modified version of the method according to the invention.

FIG. 6 illustrates an embodiment of the apparatus according to the invention wherein the coupling of fitting 5 is equipped with a sealed cover member 31 which may be opened and closed by a drive mechanism 32. The sealing may be accomplished, for example, by means of a sealing ring 32. In this embodiment, the evacuation conduit 3', shown in FIG. 1, is obviated because the charging of the pressure casting apparatus 4 with metal to be cast takes place in the conventional manner through the filling opening 11 when the cover 31 of the coupling 5 is open. After the filling of the metal the cover 31 is closed whereupon the evacuation begins through the evacuating conduit 6.

Figure 7:
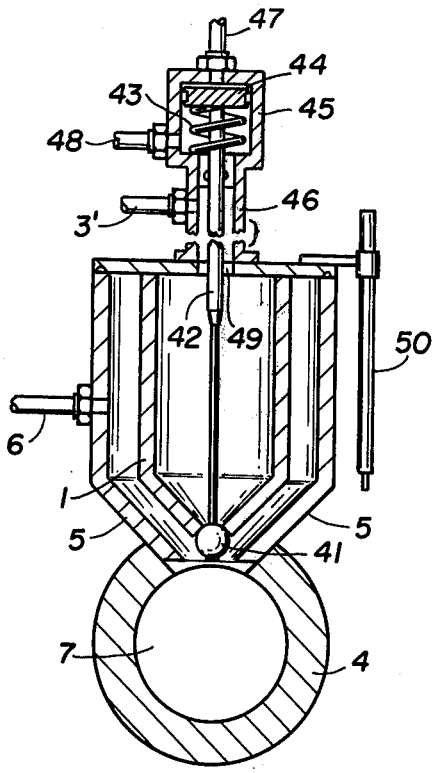
FIG. 7 illustrates a sectional view through the coupling or fitting between the transport container and the casting apparatus according to FIG. 1 on an enlarged scale.

The embodiment of the transport container 1, as shown in FIG. 7, comprises a metal closure valve in the form of a ball or sphere 41 connected to a pull rod 42. The ball 41 is kept in the closing position by means of a pressure spring 43 effective through the pull rod 42. The upper end of the pull rod 42 is provided with a piston 44 in a control cylinder 45 which is secured through a bushing 46 to the upper side of the closure plate 16. The piston 44 may be moved up and down by pneumatic means effective through the control conduits 47 and 48 whereby the piston 44 is moved against the bias of the spring 43. The evacuating conduit 3' is connected to the bushing 46 which communicates with the space inside the transport container 1 through a bore 49.

A sensor 50 is preferably secured to the closure plate 16 for determining the metal quantity which flows into the transport container 1 when the latter is dipped into the molten metal in the furnace 15.

A substantial advantage of the invention is seen in that it is not necessary to switch off the vacuum suction during the casting operation. As mentioned, according to the invention, it is possible to maintain the suction or evacuation until the completion and even after the completion of the pressure casting operation. A further advantage of performing the method, according to the invention, is seen in that the casting pressures may be reduced up to 40% and under certain circumstances even to a larger extent. Further, the production and operation costs for a pressure or die casting apparatus according to the invention are substantially lower than the respective costs of prior art pressure die cast machines including vacuum systems.

The attachment block 10, according to the invention, may be employed in all prior art pressure casting devices without any special adaptation requirements, whereby a substantially improved cast product is obtained which is especially free of so called shrink holes or pipes.

Another substantial advantage of the invention is seen in the simplicity of the method and that its performance is safe. The same applies to the equipment according to the invention, for performing the described method.

Figure 8:
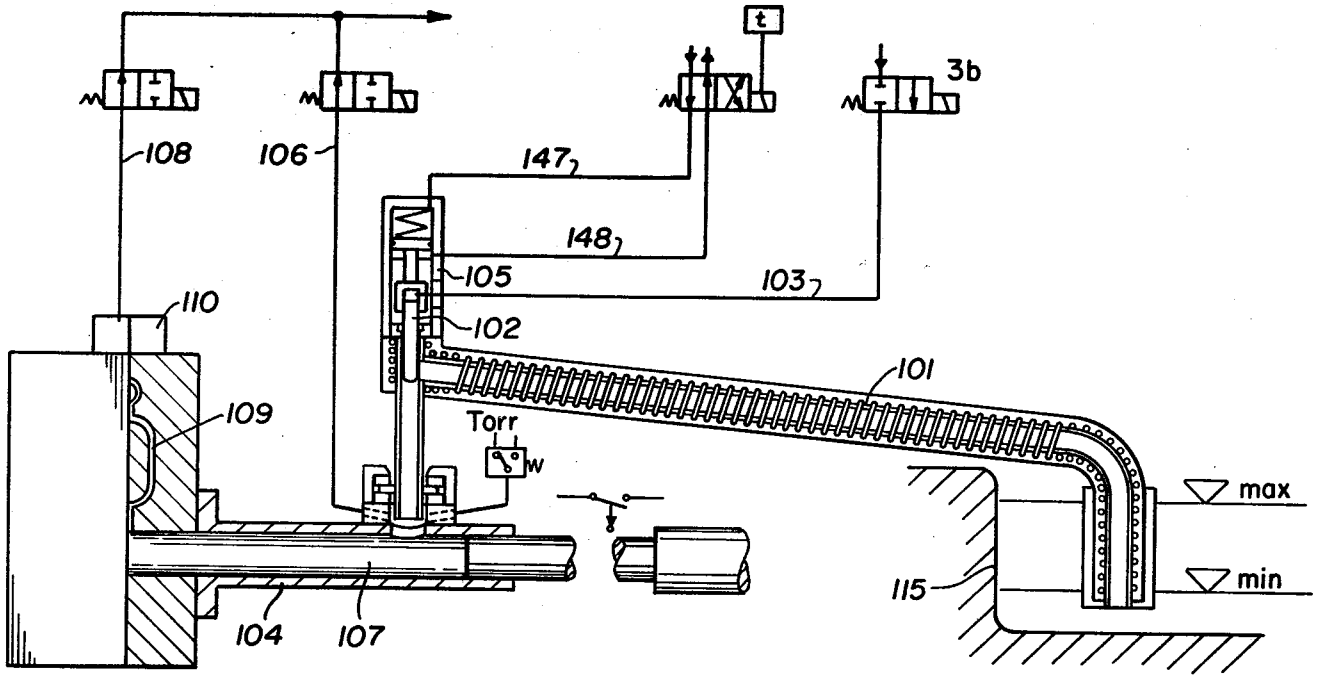
FIG. 8 illustrates a side view, partially in section, of a modification of the apparatus according to the invention.

FIG. 8 illustrates a modified embodiment of the apparatus, according to the invention, comprising an insulated and heated pipe conduit 101, one end of which is immersed into the molten metal in the furnace 115 and the other end of which is closeable by a controlled piston 102. The other end merges into a coupling or fitting 105 the lower end of which is releasably connected with the filling chamber 107. An evacuation conduit 106 is connected to the coupling or fitting 105. A further evacuation conduit 108 is connected to the vent opening or rather to the attachment block 110 of the pressure casting mold or die 109.

Figure 9:
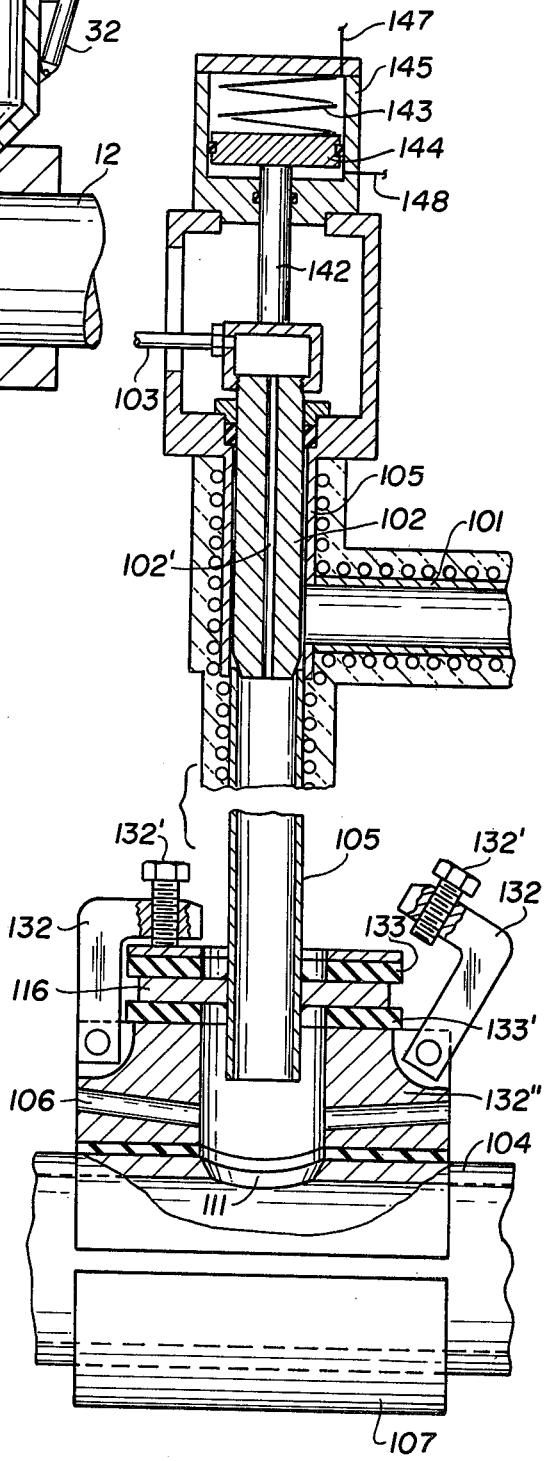
FIG. 9 is a sectional view through the coupling or fitting between a piston control conduit and the filling chamber on an enlarged scale.

The piston 102 is movable in the coupling 105 to open or close the end of the conduit 101 merging into the coupling 105. As shown in FIG. 9, the piston 102 has a longitudinal bore 102' which is connected to an evacuation conduit 103. In the illustrated example, the piston 102 may be controlled by pneumatic means. The pneumatic control pressure is supplied through the conduits 147, 148 and is effective on a control piston 144 in the control cylinder 145. The control piston 144 is connected to the piston 102 by means of a pull rod 142. The control piston 144 and thus the piston 102 are continuously biased by a pressure spring 143. The lower end of the coupling 105 is releasably connected to the filling opening 111 of the filling chamber 107 in the pressure die casting apparatus 104.

As shown in FIG. 9, the lower end of the coupling 105 is secured to a flange disk 116 which supports on both sides sealing rings 133, 133'. The flange disk 116 with its sealings rings 133, 133' may be clamped by means of a tilting bail 132 including clamping screws 132', in such a manner that the lower mouth of the coupling 105 is tightly sealed to the filling opening 111 of the filling chamber 107.

The tilting bails 132 are supported in a clamping member 132' which is releasably secured to the wall of the filling chamber 107 of the apparatus 104.

Although the invention has been described with reference to specific example embodiments, it will be appreciated, that it is intended to cover all modifications and equivalents within the scope of the appended claims.

What is claimed is:

1. An apparatus for the transporting of molten metal from a melt supply into a die means for pressure casting, said die means having a filling opening, comprising evacuable die filling means arranged for cooperation with said filling opening of said die means, metal melt transport means comprising melt container means (1), tilting drive means (3), first arm means (2), shaft means (150) operatively connecting one end (151) of said first arm means (2) to said drive means (3) for rotating said first arm means (2) through an arc (152), second arm means (153), journal means (154) operatively interconnecting the other end (155) of said first arm means (2) and said second arm means (153) so that said second arm means will extend substantially vertically in any position of said first arm means (2), and means connecting said melt container means (1) to said second arm means (153).

2. The apparatus of claim 2, wherein said melt container means (1) and said evacuable filling means (5) comprise common cover means (16) which initially close said melt container means in a vacuum tight manner and which also close said filling means (5) in a vacuum tight manner when said melt container means (1) is enclosed in said filling means (5).

3. The apparatus of claim 1, wherein said first arm means provides a parallel guide means for said melt container means.

4. The apparatus of claim 1, wherein said melt container means (1) comprise a substantially cylindrical chamber having a conical bottom with a central discharge opening in said conical bottom, wherein said second arm means comprise a hollow, tubular member connectable to said melt container means, stopper means operatively arranged inside said hollow, tubular member and means operatively connected to said stopper means for operating the stopper means to open and close said discharge opening of said melt container means.

5. The apparatus of claim 4, further comprising evacuation conduit means operatively connected to said hollow, tubular member, and means communicating the inside of said hollow, tubular member with the inside of said melt container means whereby the latter is evacuable.

6. The apparatus of claim 4, further comprising piston means and cylinder means, said cylinder means forming part of said hollow, tubular member, said piston means forming part of said stopper means, and pressure medium conduit means operatively connected to said cylinder means for moving said piston means to open and close said discharge opening of said melt container means.

7. The apparatus of claim 1, further comprising means (3') operatively connected to said melt container means (1) for evacuating said melt container means (1) simultaneously or prior to the filling of the molten metal into the die means.

8. The apparatus of claim 1, wherein said journal means (154) extend substantially at a right angle laterally away from said first arm means so that said second arm means (153) may freely clear said first arm means as the latter is tilted through said arc.

* * * * *